US008375758B1

(12) United States Patent
Matsen et al.

(10) Patent No.: US 8,375,758 B1
(45) Date of Patent: Feb. 19, 2013

(54) INDUCTION FORMING OF METAL COMPONENTS WITH SLOTTED SUSCEPTORS

(75) Inventors: Marc R. Matsen, Seattle, WA (US); William Dykstra, Rockford, MI (US)

(73) Assignee: The Boeing Company, Chicago, IL (US)

( * ) Notice: Subject to any disclaimer, the term of this patent is extended or adjusted under 35 U.S.C. 154(b) by 287 days.

(21) Appl. No.: 12/835,207

(22) Filed: Jul. 13, 2010

Related U.S. Application Data

(63) Continuation-in-part of application No. 12/817,459, filed on Jun. 17, 2010, which is a continuation-in-part of application No. 11/854,733, filed on Sep. 13, 2007, now Pat. No. 8,017,059.

(51) Int. Cl.
*B21D 22/00* (2006.01)
*B21D 37/16* (2006.01)

(52) U.S. Cl. ..... 72/60; 72/342.7

(58) Field of Classification Search ..... 72/60, 342.1, 72/342.4, 342.6, 342.7, 342.92, 342.96; 219/634; 249/114.1, 115, 116
See application file for complete search history.

(56) References Cited

U.S. PATENT DOCUMENTS

| | | | |
|---|---|---|---|
| 1,910,015 | A | 5/1933 | Homand |
| 2,106,614 | A | 1/1938 | Lindner |
| 2,317,597 | A | 4/1943 | Ford et al. |
| 3,413,392 | A | 11/1968 | Meadows |
| 3,650,042 | A | 3/1972 | Boerger et al. |
| 3,763,293 | A | 10/1973 | Nussbaum |
| 4,182,397 | A | 1/1980 | Schmucker et al. |
| 4,217,325 | A | 8/1980 | Colby |
| 4,327,045 | A | 4/1982 | Nishikawa et al. |
| 4,683,018 | A | 7/1987 | Sutcliffe et al. |
| 4,940,563 | A | 7/1990 | Kromrey |
| 4,983,341 | A | 1/1991 | Kromrey |
| 4,983,345 | A | 1/1991 | Kromrey |
| 5,009,687 | A | 4/1991 | Kromrey |
| 5,064,597 | A | 11/1991 | Kim |
| 5,188,692 | A | 2/1993 | Horvath |
| 5,338,497 | A | 8/1994 | Murray et al. |
| 5,410,132 | A | 4/1995 | Gregg et al. |
| 5,413,661 | A | 5/1995 | Spengler et al. |
| 5,483,043 | A | 1/1996 | Sturman, Jr. et al. |

(Continued)

FOREIGN PATENT DOCUMENTS

| | | |
|---|---|---|
| FR | 2696676 | 4/1994 |
| GB | 2430177 | 3/2007 |

(Continued)

OTHER PUBLICATIONS

International Search Report mailed in connection with PCT/US2008/077039 on Jun. 12, 2009 (5 pages).

(Continued)

*Primary Examiner* — Teresa M Ekiert
(74) *Attorney, Agent, or Firm* — Hanley, Flight & Zimmerman, LLC

(57) ABSTRACT

A laminated tooling apparatus includes a first tooling die, a first susceptor carried by the first tooling die and having at least one straight susceptor portion and at least one angled susceptor portion adjacent to the straight susceptor portion, a first plurality of susceptor slots extending through the at least one angled susceptor portion of the first tooling die, a second tooling die adjacent to the first tooling die, a second susceptor carried by the second tooling die and having at least one straight susceptor portion and at least one angled susceptor portion adjacent to the straight susceptor portion; and a second plurality of susceptor slots extending through the at least one angled susceptor portion of the second tooling die.

20 Claims, 12 Drawing Sheets

U.S. PATENT DOCUMENTS

| | | | | |
|---|---|---|---|---|
| 5,529,479 | A | 6/1996 | Souders | |
| 5,530,227 | A | 6/1996 | Matsen et al. | |
| 5,591,369 | A | 1/1997 | Matsen et al. | |
| 5,591,370 | A | 1/1997 | Matsen et al. | |
| 5,599,472 | A | 2/1997 | Brown et al. | |
| 5,645,744 | A | 7/1997 | Matsen et al. | |
| 5,705,794 | A | 1/1998 | Gillespie et al. | |
| 5,728,309 | A | 3/1998 | Matsen et al. | |
| 5,808,281 | A | 9/1998 | Matsen et al. | |
| 5,885,504 | A | 3/1999 | David et al. | |
| 5,989,008 | A | 11/1999 | Wytkin | |
| 6,040,563 | A | 3/2000 | Matsen et al. | |
| 6,149,844 | A | 11/2000 | Graham | |
| 6,211,497 | B1 | 4/2001 | Matsen et al. | |
| 6,284,089 | B1 | 9/2001 | Anderson et al. | |
| 6,299,819 | B1 | 10/2001 | Han | |
| 6,310,327 | B1 | 10/2001 | Moore et al. | |
| 6,524,511 | B1 | 2/2003 | Ueki et al. | |
| 6,528,771 | B1 | 3/2003 | Matsen et al. | |
| 6,529,796 | B1 | 3/2003 | Kroeger et al. | |
| 6,565,792 | B2 | 5/2003 | Hemphill | |
| 6,565,942 | B2 | 5/2003 | Anderson et al. | |
| 6,566,635 | B1 | 5/2003 | Matsen et al. | |
| 6,653,608 | B1 | 11/2003 | Matsen et al. | |
| 6,747,253 | B1 * | 6/2004 | Firth et al. | 219/634 |
| 6,812,271 | B2 | 11/2004 | Swartz et al. | |
| 6,840,750 | B2 | 1/2005 | Thrash et al. | |
| 6,855,917 | B2 | 2/2005 | Matsen et al. | |
| 6,884,966 | B2 | 4/2005 | Coleman et al. | |
| 6,897,419 | B1 | 5/2005 | Brown et al. | |
| 6,906,300 | B2 | 6/2005 | Brown et al. | |
| 6,914,225 | B2 | 7/2005 | Fischer et al. | |
| 6,979,807 | B2 | 12/2005 | Anderson et al. | |
| 6,991,446 | B2 | 1/2006 | Byma et al. | |
| 7,024,897 | B2 | 4/2006 | Pfaffmann et al. | |
| 7,102,112 | B2 | 9/2006 | Anderson et al. | |
| 7,109,451 | B2 | 9/2006 | Brown et al. | |
| 7,159,836 | B2 | 1/2007 | Parks et al. | |
| 7,269,986 | B2 | 9/2007 | Pfaffmann et al. | |
| 7,351,054 | B2 | 4/2008 | Bachan | |
| 7,419,631 | B2 | 9/2008 | Guichard et al. | |
| 7,497,981 | B2 | 3/2009 | Graham | |
| 7,866,969 | B2 | 1/2011 | Ruiz et al. | |
| 7,905,128 | B2 | 3/2011 | Matsen et al. | |
| 8,017,059 | B2 | 9/2011 | Matsen et al. | |
| 2002/0025423 | A1 | 2/2002 | Dreher et al. | |
| 2002/0050667 | A1 | 5/2002 | Swartz et al. | |
| 2002/0121721 | A1 | 9/2002 | Byma et al. | |
| 2002/0157785 | A1 | 10/2002 | Anderson et al. | |
| 2002/0167119 | A1 | 11/2002 | Hemphill | |
| 2002/0185785 | A1 | 12/2002 | Thrash et al. | |
| 2004/0058027 | A1 | 3/2004 | Guichard et al. | |
| 2004/0113315 | A1 | 6/2004 | Graham | |
| 2004/0194424 | A1 | 10/2004 | Frost et al. | |
| 2005/0035116 | A1 | 2/2005 | Brown et al. | |
| 2005/0069600 | A1 | 3/2005 | Scolamiero et al. | |
| 2005/0145309 | A1 | 7/2005 | Coleman et al. | |
| 2005/0205568 | A1 | 9/2005 | Brown et al. | |
| 2006/0131473 | A1 | 6/2006 | Bachan | |
| 2006/0233907 | A1 | 10/2006 | Ruiz et al. | |
| 2007/0000602 | A1 | 1/2007 | Sprague | |
| 2007/0160822 | A1 | 7/2007 | Bristow et al. | |
| 2007/0241482 | A1 | 10/2007 | Giller et al. | |
| 2009/0071217 | A1 | 3/2009 | Matsen et al. | |
| 2009/0074905 | A1 | 3/2009 | Matsen et al. | |
| 2011/0006460 | A1 | 1/2011 | Vander Wei et al. | |
| 2011/0229720 | A1 | 9/2011 | Matsen et al. | |
| 2011/0262575 | A1 | 10/2011 | Matsen et al. | |

FOREIGN PATENT DOCUMENTS

| | | |
|---|---|---|
| WO | 2009036473 | 3/2009 |
| WO | 2011115716 | 9/2011 |

OTHER PUBLICATIONS

International Preliminary Report on Patentability mailed in connection with PCT/US2008/077039 on Mar. 16, 2010 (10 pages).

Written Opinion of the International Searching Authority mailed in connection with PCT/US2008/077039 on Mar. 13, 2010 (9 pages).

Notice of Allowance issued by the United States Patent and Trademark Office in connection with U.S. Appl. No. 11/854,733 on May 19, 2011 (5 pages).

Notice of Allowance issued by the United States Patent and Trademark Office in connection with U.S. Appl. No. 11/859,098 on Oct. 3, 2012 (8 pages).

* cited by examiner

INDUCTION FORMING OF METAL COMPONENTS WITH SLOTTED SUSCEPTORS

CROSS-REFERENCE TO RELATED APPLICATIONS

This application is a continuation-in-part of U.S. Utility patent application Ser. No. 12/817,459, filed Jun. 17, 2010 and entitled "INDUCTION FORMING OF METAL COMPONENTS WITH INTEGRAL HEAT TREATMENT", which is a continuation-in-part of U.S. Utility patent application Ser. No. 11/854,733, filed Sep. 13, 2007, now U.S. Pat. No. 8,017,059 and entitled COMPOSITE FABRICATION APPARATUS AND METHOD, which utility patent applications are incorporated by reference herein in their entireties.

This invention was made with Government support under contract number DE-FG36-080018135 awarded by the United States Department of Energy. The government has certain rights in this invention.

TECHNICAL FIELD

The disclosure relates to composite fabrication apparatus and methods. More particularly, the disclosure relates to a laminated tooling apparatus with smart susceptors which enables control of temperature during induction heating of complex components regardless of whether the magnetic field produced by the induction coil is running parallel or perpendicular to the back surface of the susceptor.

BACKGROUND

Processing techniques and facilities which enable widespread use of molded thermoplastic composite components at production rates and production costs and that allow significant weight savings scenarios may be desirable in some applications. The capability to rapidly heat, consolidate and cool in a controlled manner may be required for high production rates of composite components. Current processing techniques include the use of heated dies, and therefore, may not allow for the optimum controlled cool-down which may be required for optimum fabrication. Furthermore, current processing techniques may have limitations in forming the desired components since such techniques have limitations in the capability to hold the dimensions of the component accurately or maintain the composite in a fully consolidated state and may not optimize performance of the current resin systems.

Superplastic forming and hot forming methods for fabricating aluminum and to some extent magnesium components may be hampered by the inability to effectively integrate the superplastic forming process with the heat treatment requirements. The savings produced by the excellent formability at SPF temperatures may be nullified by the loss of dimensional control due to the need to solution-treat and quench the component after superplastic forming to produce competitive strength characteristics.

The lower strength of non-heat treatable alloys may be a significant contributing factor mainly as to why there has not been widespread implementation of the SPF of aluminum components in the aerospace industry. Moreover, the long cycles and low strength of characteristic of the current process may be deterrents to using the SPF of aluminum and magnesium in the automotive industry.

When inductively heating complex geometry smart susceptors, the magnetic field produced by the induction coil may tend to hug the back surface of the smart susceptor. When the susceptor becomes nonmagnetic at the Curie Point of the ferromagnetic material making up the susceptor, there may be a significant reduction in energy input into the susceptor. This may be especially true when the magnetic field is parallel to the plane of the susceptor. The magnetic field may have a tendency to straighten out and not hug the back surface of the smart susceptor when the smart susceptor is nonmagnetic. This may cause issues for complex geometry susceptors as the field penetrates through the susceptor thickness. The reduction in efficiency may not be as dramatic when the magnetic field is not parallel to the plane of the susceptor. Therefore, the more dramatic the complexity of the smart susceptor, the more chances for areas that do not stop heating abruptly at the Curie Point.

Therefore, a laminated tooling apparatus with smart susceptors which enables control of temperature during induction heating of complex components regardless of whether the magnetic field produced by the induction coil is running parallel or perpendicular to the back surface of the susceptor is needed.

SUMMARY

The disclosure is generally directed to a laminated tooling apparatus. An illustrative embodiment of the apparatus includes a first tooling die, a first susceptor carried by the first tooling die and having at least one straight susceptor portion and at least one angled susceptor portion adjacent to the straight susceptor portion, a first plurality of susceptor slots extending through the at least one angled susceptor portion of the first tooling die, a second tooling die adjacent to the first tooling die, a second susceptor carried by the second tooling die and having at least one straight susceptor portion and at least one angled susceptor portion adjacent to the straight susceptor portion; and a second plurality of susceptor slots extending through the at least one angled susceptor portion of the second tooling die. The susceptor then may have a non-conductive coating placed over these very thin susceptor slots in the smart susceptor tool surface.

In some embodiments, the laminated tooling apparatus may include a first tooling die; a first susceptor carried by the first tooling die and having a plurality of straight susceptor portions and a plurality of angled susceptor portions adjacent to the straight susceptor portions; a first plurality of susceptor slots extending through the at least one angled susceptor portion of the first tooling die; a second tooling die adjacent to the first tooling die; a second susceptor carried by the second tooling die and having a plurality of straight susceptor portions and a plurality of angled susceptor portions adjacent to the straight susceptor portions; and a second plurality of susceptor slots extending partially through the at least one angled susceptor portion of the second tooling die.

The disclosure is further generally directed to a method of enhancing induction heating control of a susceptor in a laminated tooling apparatus. An illustrative embodiment of the method includes providing susceptors each having at least one straight susceptor portion and at least one angled susceptor portion adjacent to the at least one straight susceptor portion, extending susceptor slots through the angled susceptor portions, placing the susceptors between first and second tooling dies, placing a part between the susceptors and shaping the part by heating the susceptors.

BRIEF DESCRIPTION OF THE ILLUSTRATIONS

DETAILED. DESCRIPTION

Figure 1:
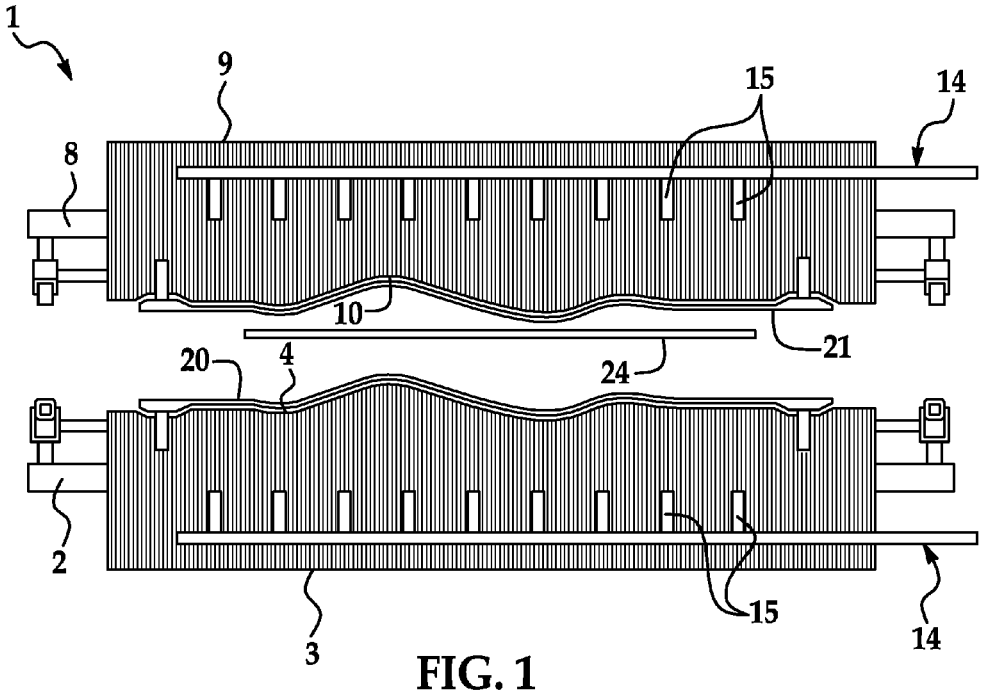
FIG. 1 is a sectional view of a pair of tooling dies of a stacked tooling apparatus, with molding compounds positioned between the tooling dies.

Referring initially to FIGS. 1-7 of the drawings, a stacked tooling apparatus which is suitable for implementation of the composite fabrication method is generally indicated by reference numeral 1. The stacked tooling apparatus 1 may include a first die frame 2 and a second die frame 8. A first tooling die 3 may be provided on the first die frame 2, and a second tooling die 9 may be provided on the second die frame 8. The first tooling die 3 and the second tooling die 9 may be hydraulically-actuated to facilitate movement of the first tooling die 3 and the second tooling die 9 toward and away from each other. The first tooling die 3 may have a first contoured die surface 4, whereas the second tooling die 9 may have a second contoured die surface 10 which is complementary to the first contoured die surface 4 of the first tooling die 3.

Figure 5:
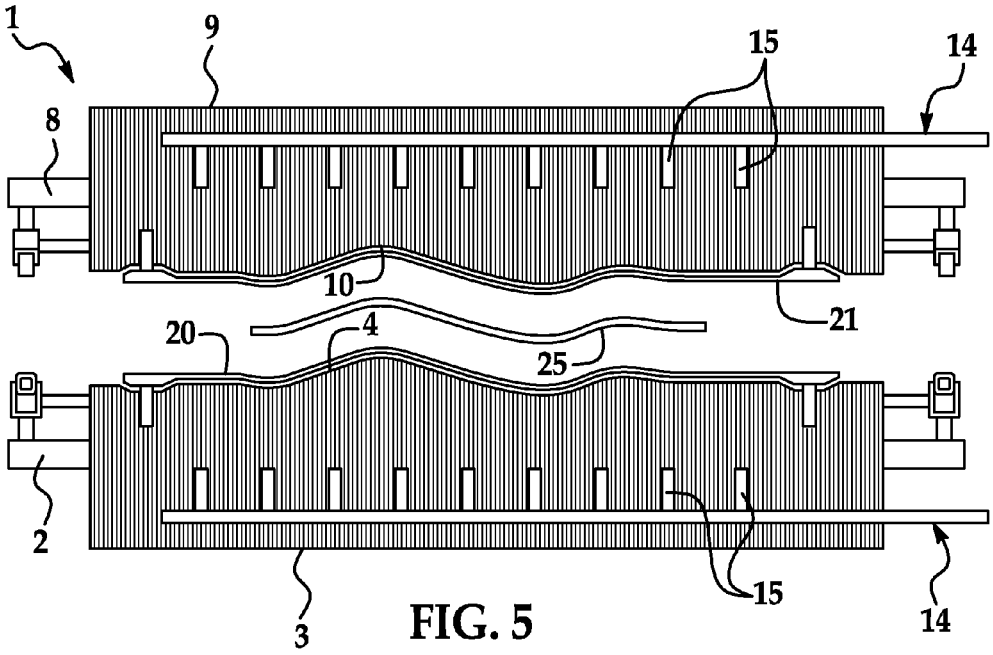
FIG. 5 is a sectional view of the tooling dies, with the tooling dies and die susceptors released from the composite sheet after forming and cooling of the composite sheet.
Figure 6:
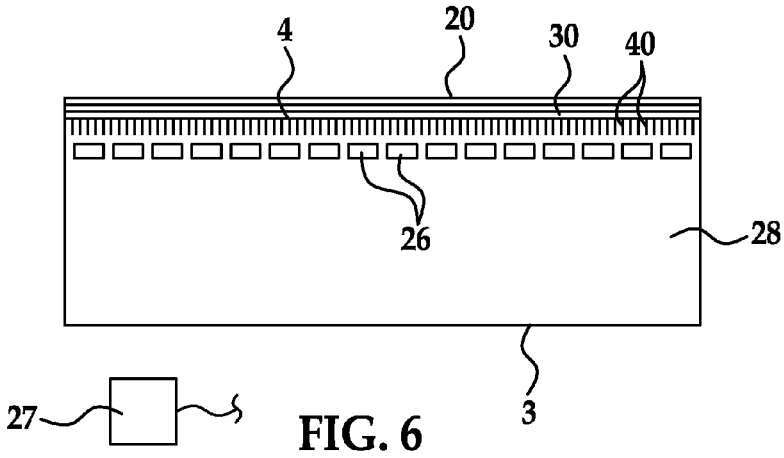
FIG. 6 is a schematic view of a tooling die, more particularly illustrating a die susceptor and die liner provided on the engaging surface of the tooling die and multiple induction coils extending through the tooling die.

As shown in FIG. 6, multiple induction coils 26 may extend through each of the first tooling die 3 (and the second tooling die 9, not shown) to facilitate selective heating of the first tooling die 3 and the second tooling die 9. A thermal control system 27 may be connected to the induction coils 26. A first die susceptor 20 may be thermally coupled to the induction coils 26 of the first tooling die 3. A second die susceptor 21 may be thermally coupled to the induction coils 26 of the second tooling die 9. Each of the first die susceptor 20 and the second die susceptor 21 may be a thermally-conductive material such as, but not limited to, a ferromagnetic material, cobalt, nickel, or compounds thereof. In some embodiments, each of the first die susceptor 20 and the second die susceptor 21 may be made of alloys including one or more of the ferromagnetic elements iron, nickel and cobalt plus other elements of lesser fractions such as molybdenum, chromium, vanadium and manganese, for example and without limitation. As shown in FIGS. 1-5, the first die susceptor 20 may generally conform to the first contoured die surface 4 and the second die susceptor 21 may generally conform to the second contoured die surface 10.

As shown in FIG. 6, an electrically and thermally insulative coating 30 may be provided on the first contoured die surface 4 of the first tooling die 3, as shown, and on the second contoured die surface 10 of the second tooling die 9 (not shown). The electrically and thermally insulative coating 30 may be, for example, alumina or silicon carbide. The first die susceptor 20 may be provided on the electrically and thermally insulative coating of the first tooling die 3, as shown, and the second die susceptor 21 may be provided on the electrically and thermally insulative coating 30 of the second tooling die 9 (not shown).

Figure 4:
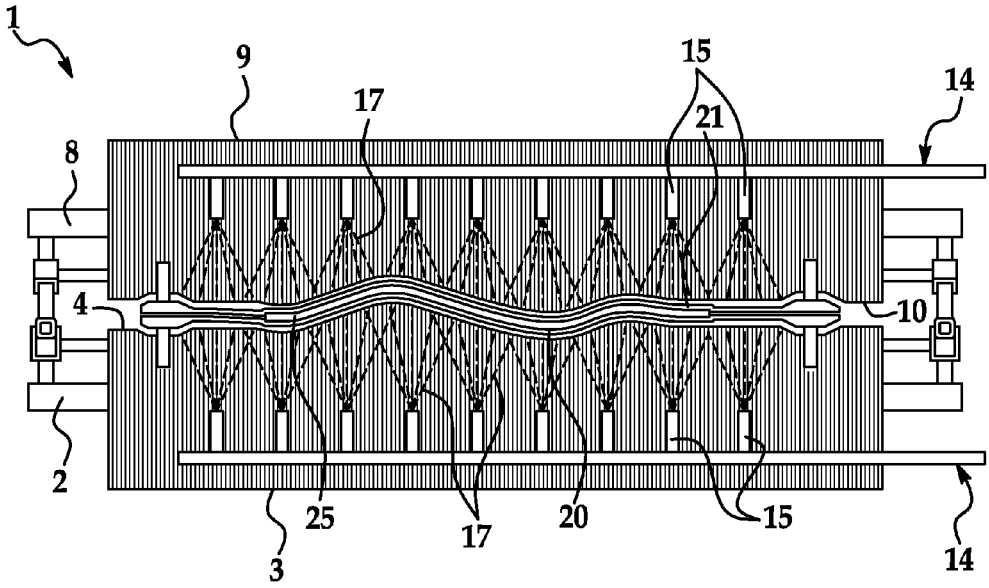
FIG. 4 is a sectional view of the tooling dies, with the tooling dies closed against the die susceptors and composite sheet and a cooling system engaged to cool the tooling dies.

As shown in FIGS. 1-5, a cooling system 14 may be provided in each of the first tooling die 3 and the second tooling die 9. The cooling system 14 may include, for example, coolant conduits 15 which have a selected distribution throughout each of the first tooling die 3 and the second tooling die 9. As shown in FIG. 4, the coolant conduit 15 may be adapted to discharge a cooling medium 17 into the first tooling die 3 or the second tooling die 9. The cooling medium 17 may be a liquid, gas or gas/liquid mixture which may be applied as a mist or aerosol, for example.

Figure 7:
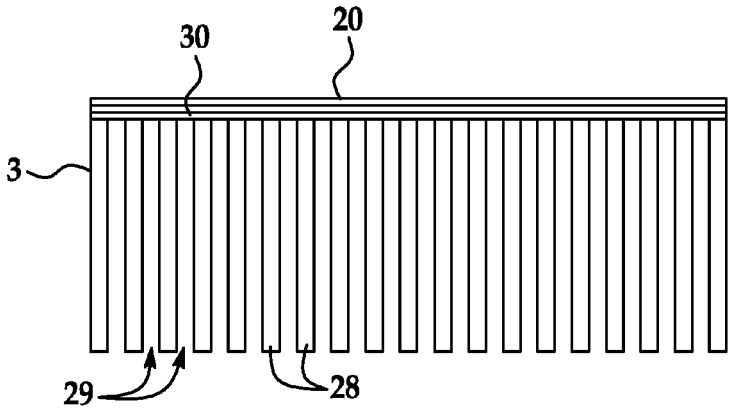
FIG. 7 is a front sectional view of a tooling die, more particularly illustrating multiple induction coils and multiple thermal expansion slots provided in the metal sheet.

Each of the first tooling die 3 and the second tooling die 9 may each include multiple stacked metal sheets 28 such as stainless steel which are trimmed to the appropriate dimensions for the induction coils 26. This is shown in FIGS. 6 and 7. The stacked metal sheets 28 may be oriented in generally perpendicular relationship with respect to the first contoured die surface 4 and the second contoured die surface 10. Each metal sheet 28 may have a thickness of from about 1/16" to about ½", for example and preferably ⅛". An air gap 29 may be provided between adjacent stacked metal sheets 28 to facilitate cooling of the first tooling die 3 and the second tooling die 9 (not shown). The stacked metal sheets 28 may be attached to each other using clamps (not shown), fasteners (not shown) and/or other suitable technique known to those skilled in the art. The stacked metal sheets 28 may be selected based on their electrical and thermal properties and may be transparent to the magnetic field. An electrically insulating coating (not shown) may, optionally, be provided on each side of each stacked sheet 28 to prevent flow of electrical current between the stacked metal sheets 28. The insulating coating may be a material such as ceramic, for example, or other high temperature resistant materials. However, if an air gap exists inbetween the stacked sheets, then no coating would be necessary. Multiple thermal expansion slots 40 may be provided in each stacked sheet 28, as shown in FIG. 6, to facilitate thermal expansion and contraction of the stacked tooling apparatus 1.

Figure 2:
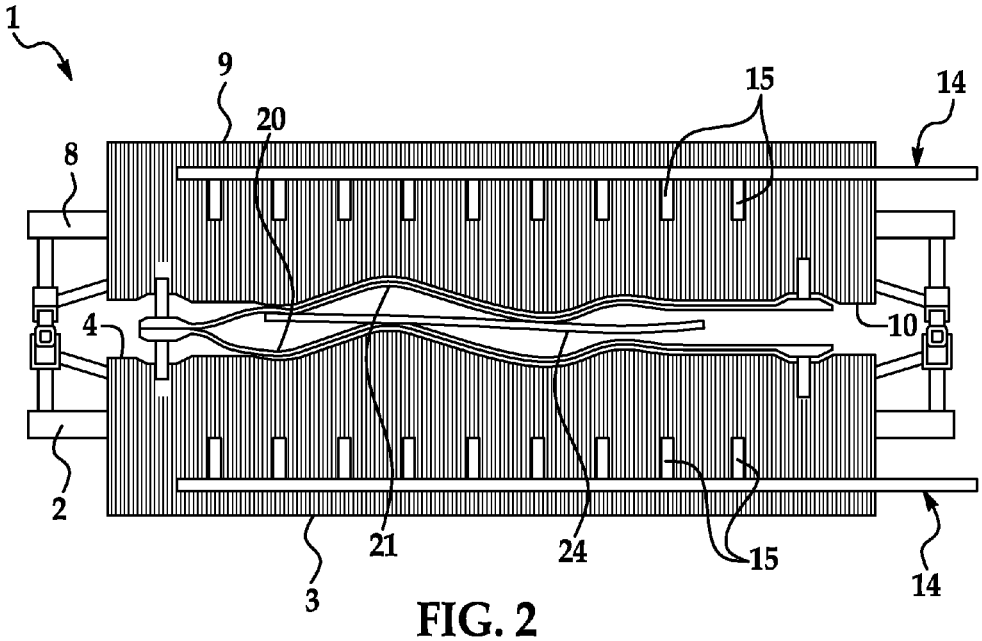
FIG. 2 is a sectional view of a pair of tooling dies, with the molding compounds enclosed between a pair of die susceptors provided on the tooling dies.
Figure 3:
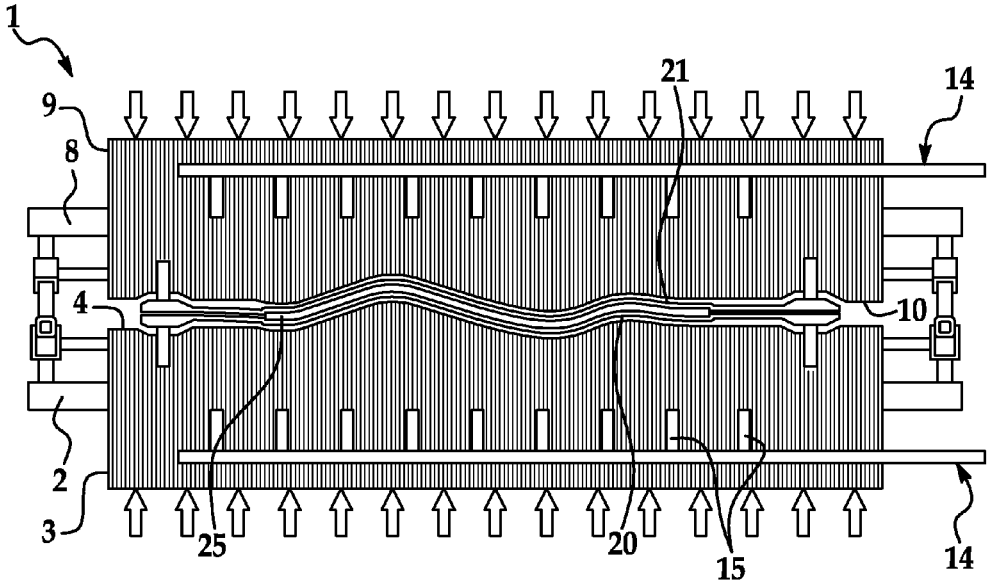
FIG. 3 is a sectional view of the tooling dies, with the tooling dies applying pressure to form and consolidate a composite sheet.

In typical implementation of the composite fabrication method, molding compounds 24 are initially positioned between the first tooling die 3 and the second tooling die 9 of the stacked tooling apparatus 1, as shown in FIG. 1. The first tooling die 3 and the second tooling die 9 are next moved toward each other, as shown in FIG. 2, as the induction coils 26 (FIG. 6) heat the first tooling die 3 and the second tooling die 9 as well as the first die susceptor 20 and the second die susceptor 21. Therefore, as the first tooling die 3 and the second tooling die 9 close toward each other, the first die susceptor 20 and the second die susceptor 21 rapidly heat the molding compounds 24. Thus, the molding compounds 24 which may be thermally molded as the first tooling die 3 and the second tooling die 9 continue to approach and then close against the molding compounds 24, as shown in FIG. 2, forming the molding compounds 24 to the configuration of a composite sheet 25 (shown in FIGS. 3-5) which may be defined by the first contoured surface 4 of the first tooling die 3 and the second contoured surface 10 of the second tooling die 9.

As shown in FIG. 4, the cooling system 14 is next operated to apply the cooling medium 17 to the first tooling die 3 and the second tooling die 9 and to the first die susceptor 20 and the second die susceptor 21. Therefore, the cooling medium 17 actively and rapidly cools the first tooling die 3 and the second tooling die 9 as well as the first die susceptor 20 and the second die susceptor 21, also cooling the composite sheet 25 sandwiched between the first die susceptor 20 and the second die susceptor 21. The composite sheet 25 remains sandwiched between the first tooling die 3 and the second tooling die 9 for a predetermined period of time until complete cooling of the composite sheet 25 has occurred. This allows the molded and consolidated composite sheet 25 to retain the structural shape which is defined by the first contoured surface 4 and the second contoured surface 10 after the first tooling die 3 and the second tooling die 9 are opened, as shown in FIG. 5. The formed and cooled composite sheet 25 is removed from the stacked tooling apparatus 1 without loss of dimensional accuracy or delamination of the composite sheet 25 when it is cooled at an appropriate property-enhancing rate.

Figure 8:
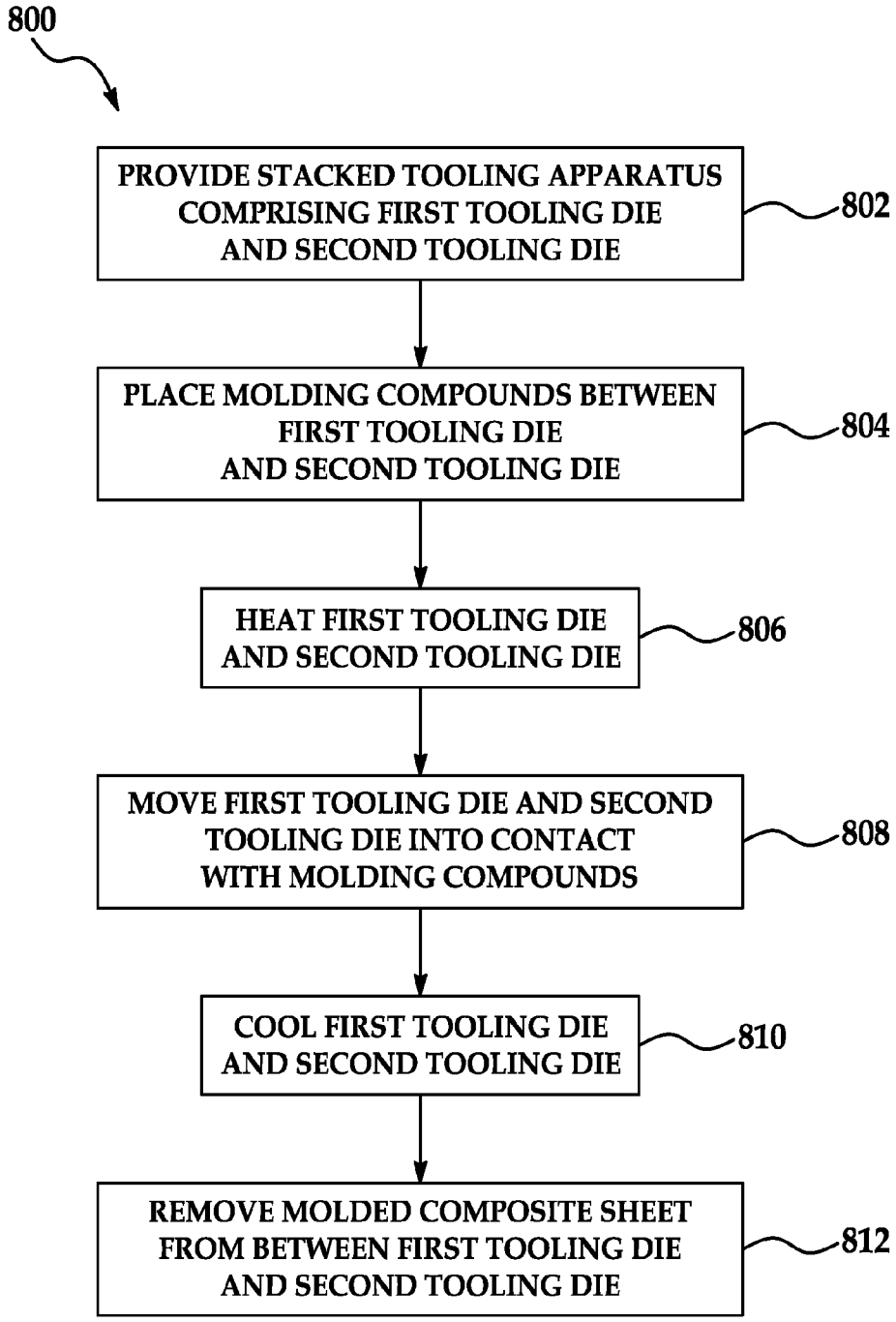
FIG. 8 is a flow diagram which illustrates an exemplary composite fabrication method.

Referring next to FIG. 8, a block diagram 800 which illustrates an exemplary composite fabrication method is shown. In block 802, a stacked tooling apparatus comprising a first tooling die and a second tooling die may be provided. In block 804, molding compounds may be placed between the first tooling die and the second tooling die. In block 806, the first tooling die and the second tooling die may be heated. In block 808, the first tooling die and the second tooling die may be moved into contact with the molding compounds. In block 810, the first tooling die and the second tooling die may be cooled. In block 812, a molded composite sheet is removed from between the first tooling die and the second tooling die.

Figure 9:
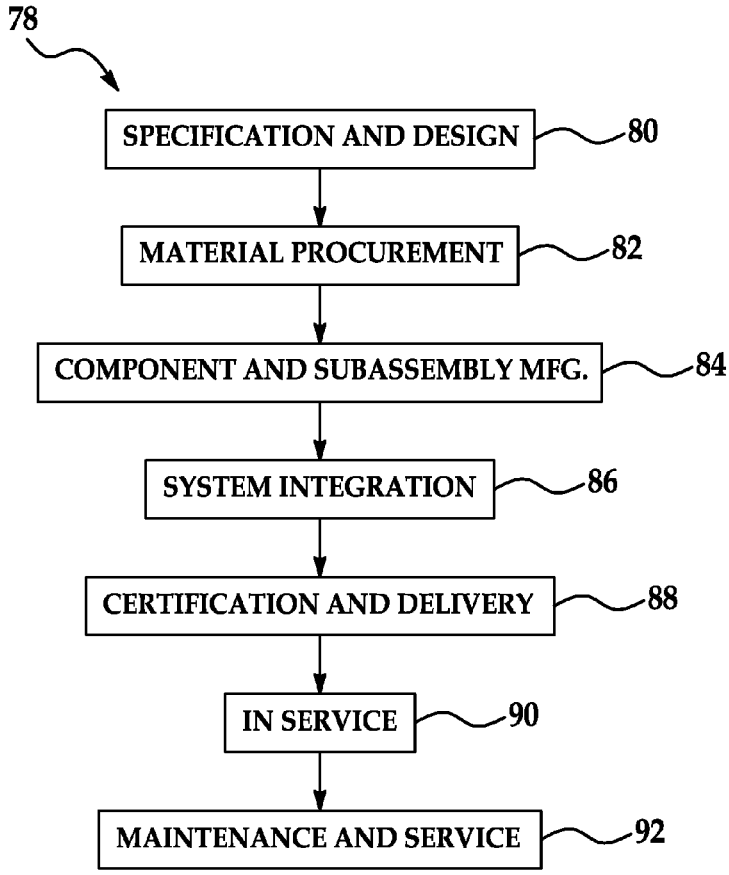
FIG. 9 is a flow diagram of an aircraft production and service methodology.
Figure 10:
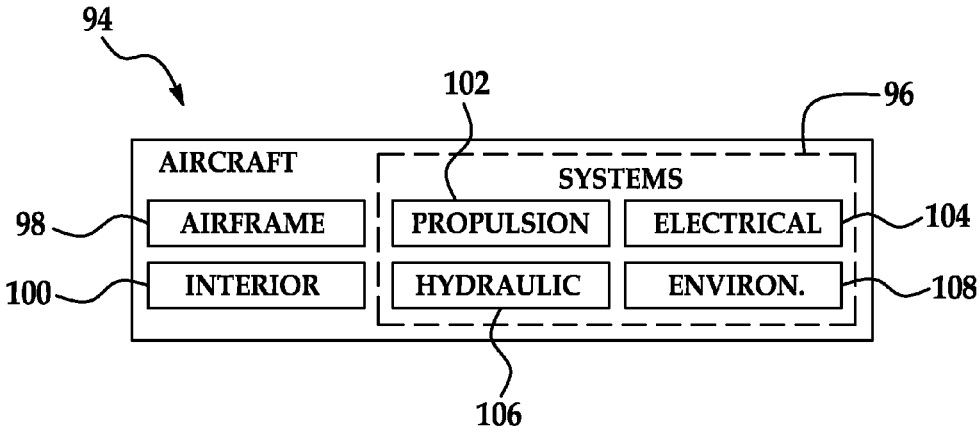
FIG. 10 is a block diagram of an aircraft.

Referring next to FIGS. 9 and 10, embodiments of the disclosure may be used in the context of an aircraft manufacturing and service method 78 as shown in FIG. 9 and an aircraft 94 as shown in FIG. 10. During pre-production, exemplary method 78 may include specification and design 80 of the aircraft 94 and material procurement 82. During production, component and subassembly manufacturing 84 and system integration 86 of the aircraft 94 takes place. Thereafter, the aircraft 94 may go through certification and delivery 88 in order to be placed in service 90. While in service by a customer, the aircraft 94 is scheduled for routine maintenance and service 90 (which may also include modification, reconfiguration, refurbishment, and so on).

Each of the processes of method 78 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 10, the aircraft 94 produced by exemplary method 78 may include an airframe 98 with a plurality of systems 96 and an interior 100. Examples of high-level systems 96 include one or more of a propulsion system 102, an electrical system 104, a hydraulic system 106, and an environmental system 108. Any number of other systems may be included. Although an aerospace example is shown, the principles of the invention may be applied to other industries, such as the automotive industry.

The apparatus embodied herein may be employed during any one or more of the stages of the production and service method 78. For example, components or subassemblies corresponding to production process 84 may be fabricated or manufactured in a manner similar to components or subassemblies produced while the aircraft 94 is in service. Also, one or more apparatus embodiments may be utilized during the production stages 84 and 86, for example, by substantially expediting assembly of or reducing the cost of an aircraft 94. Similarly, one or more apparatus embodiments may be utilized while the aircraft 94 is in service, for example and without limitation, to maintenance and service 92.

Referring next to FIGS. 11-15 of the drawings, an induction forming apparatus which is suitable for implementation of the metal induction forming method is generally indicated by reference numeral 101. The apparatus 101 may include a first die frame 102 and a second die frame 108. A first tooling die 103 may be provided on the first die frame 102, and a second tooling die 109 may be provided on the second die frame 108. The first tooling die 103 and the second tooling die 109 may be hydraulically-actuated to facilitate movement of the first tooling die 103 and the second tooling die 109 toward and away from each other. The first tooling die 103 may have a first contoured die surface 104, whereas the second tooling die 109 may have a second contoured die surface 110 which is complementary to the first contoured die surface 104 of the first tooling die 103.

Figure 14:
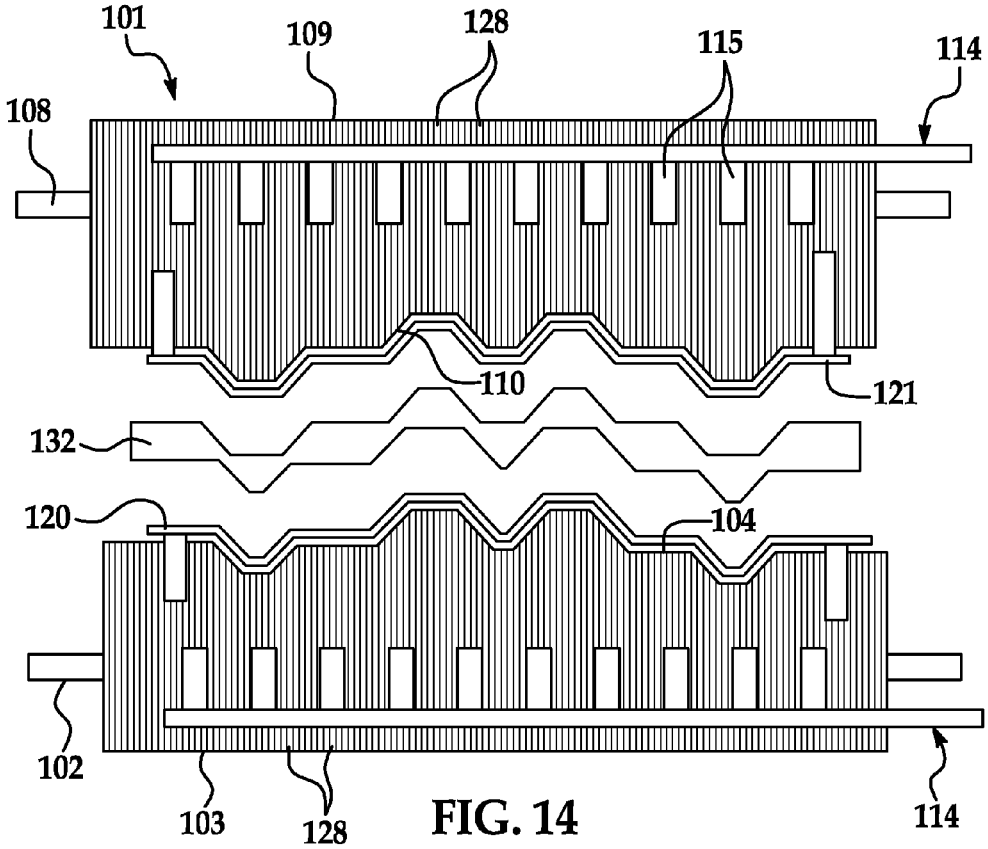
FIG. 14 is a sectional view of the tooling dies of the induction forming apparatus, with the tooling dies and die susceptors released from the shaped metal panel after forming and cooling of the metal sheet.
Figure 15:
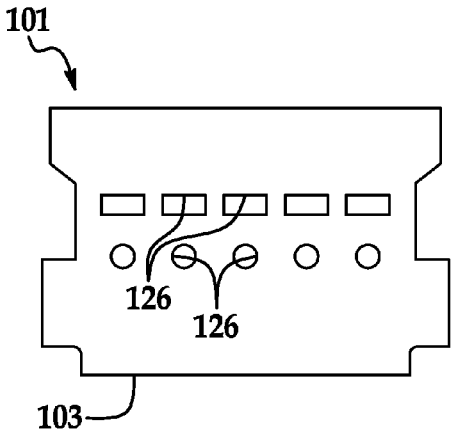
FIG. 15 is an end view of a tooling die of the induction forming apparatus, more particularly illustrating multiple induction coils extending through the tooling die.

As shown in FIG. 15, at least one set of induction coils 126 may extend through each of the first tooling die 103 (and the second tooling die 9, not shown) to facilitate selective heating of the first tooling die 103 and the second tooling die 109. In some embodiments, the induction coils 126 may be solenoid-shaped. A thermal control system 127 may be connected to the induction coils 126. A first die susceptor 120 may be thermally coupled to the induction coils 126 of the first tooling die 103. A second die susceptor 121 may be thermally coupled to the induction coils 126 of the second tooling die 109. Each of the first die susceptor 120 and the second die susceptor 121 may be a thermally-conductive material such as, but not limited to, a ferromagnetic material, cobalt, nickel, or compounds thereof. In some embodiments, each of the first die susceptor 120 and the second die susceptor 121 may be made of alloys including one or more of the ferromagnetic elements iron, nickel and cobalt plus other elements of lesser fractions such as molybdenum, chromium, vanadium and manganese, for example and without limitation. As shown in FIGS. 11-14, the first die susceptor 120 may generally conform to the first contoured die surface 104 and the second die susceptor 121 may generally conform to the second contoured die surface 110.

Figure 11:
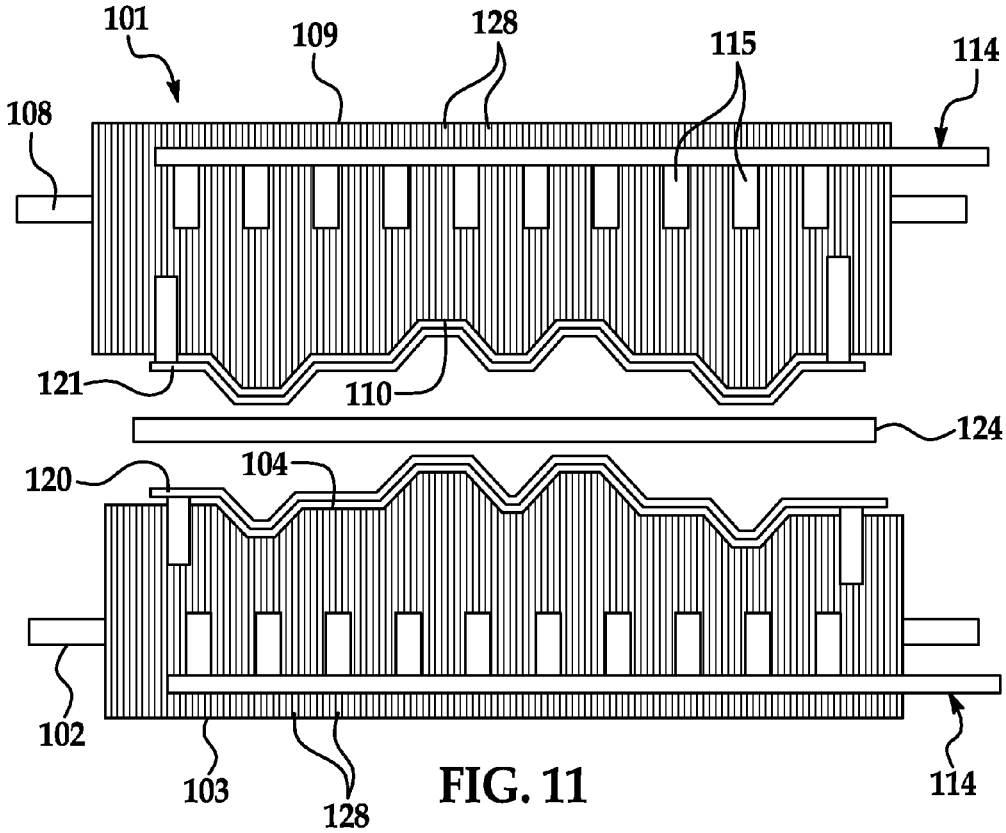
FIG. 11 is a sectional view of a pair of tooling dies of an induction forming apparatus, with a metal sheet positioned between the tooling dies.
Figure 12:
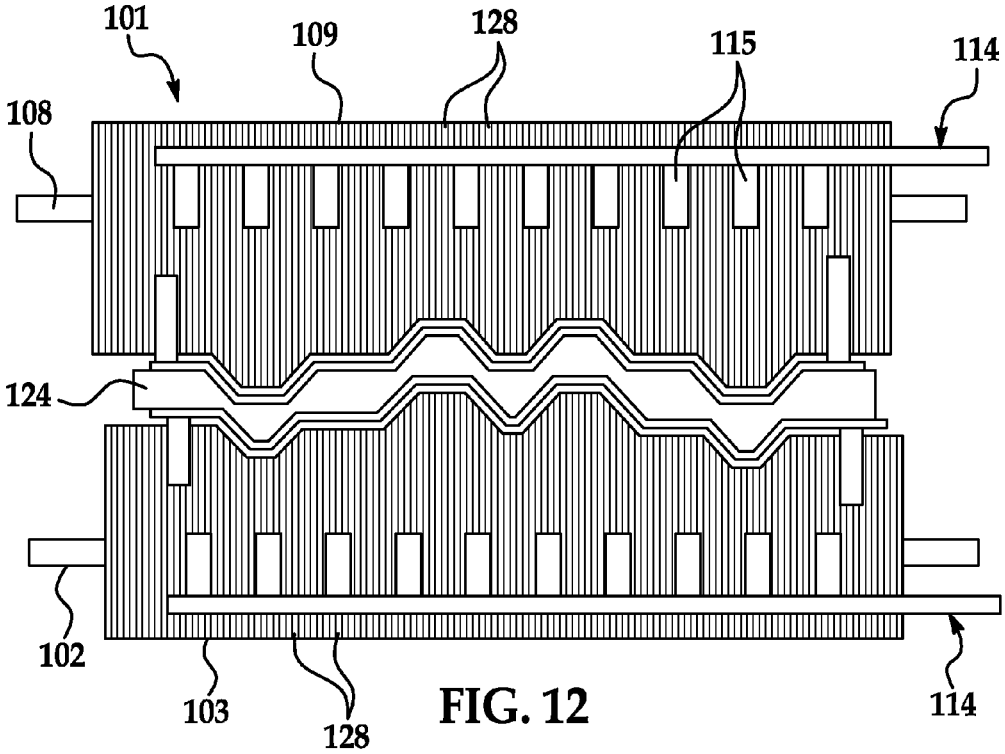
FIG. 12 is a sectional view of a pair of tooling dies of the induction forming apparatus, with the metal sheet enclosed between a pair of die susceptors provided on the tooling dies and the tooling dies applying pressure to form a shaped metal panel.
Figure 13:
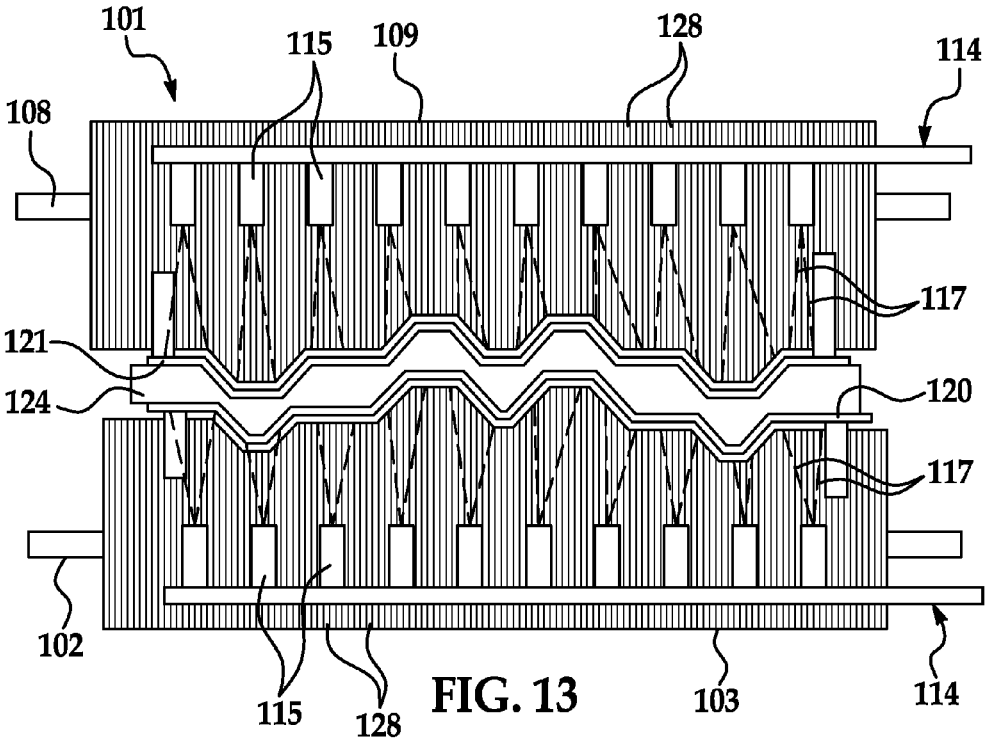
FIG. 13 is a sectional view of the tooling dies of the induction forming apparatus, with the tooling dies closed against the die susceptors and metal sheet and a cooling system engaged to cool the tooling dies and quench the shaped metal panel.

As shown in FIGS. 11-14, a cooling system 114 may be provided in each of the first tooling die 103 and the second tooling die 109. The cooling system 114 may include, for example, coolant conduits 115 which have a selected distribution throughout each of the first tooling die 103 and the second tooling die 109. As shown in FIG. 13, the coolant conduit 115 may be adapted to discharge a quenching medium 117 into the first tooling die 103 or the second tooling die 109. The quenching medium 117 may be a liquid, gas or gas/liquid mixture which may be applied as a mist or aerosol, for example. In some applications, the quenching medium 117 may be water.

Each of the first tooling die 103 and the second tooling die 109 may each include multiple laminated metal sheets 128 such as stainless steel which are trimmed to the appropriate dimensions for the induction coils 126. The stacked metal sheets 128 may be oriented in generally perpendicular relationship with respect to the induction coils 126. An air gap (not shown) may be provided between adjacent stacked metal sheets 128 to facilitate cooling of the first tooling die 103 and the second tooling die 109 (not shown). The laminated metal sheets 128 may be attached to each other using clamps (not shown), fasteners (not shown) and/or other suitable technique known to those skilled in the art. The laminated metal sheets 28 may be selected based on their electrical and thermal properties and may be transparent to the magnetic field. An electrically insulating coating (not shown) may, optionally, be provided on each side of each laminated sheet 128 to prevent flow of electrical current between the laminated metal sheets 128. The insulating coating may be a material such as ceramic, for example, or other high temperature resistant materials. However, if an air gap exists in between the stacked sheets, then no coating may be necessary. Multiple thermal expansion slots (not shown) may be provided in each stacked sheet 128 to facilitate thermal expansion and contraction of the apparatus 101.

In typical implementation of the metal induction forming method, a metal plate 124 is initially positioned between the first tooling die 103 and the second tooling die 109 of the stacked tooling apparatus 101, as shown in FIG. 11. In some applications, the metal plate 124 may be aluminum, magnesium or alloys thereof, for example and without limitation. The first tooling die 103 and the second tooling die 109 are next moved toward each other, as shown in FIG. 12, until the metal plate 124 is initially partially formed between the first die susceptor 120 and the second die susceptor 121. Once the cold forming limit of the metal plate 124 is reached, the induction coils 126 are energized to heat the first die susceptor 120 and the second die susceptor 121 to the induction forming temperature. In aluminum alloy applications, the induction forming temperature may be between about 900~1000 degrees F. Accordingly, the induction coils 126 heat the first die susceptor 120 and the second die susceptor 121, which form or shape the metal sheet 124 to the contour of the first contoured die surface 104 and the second contoured die surface 110. This step may also include the stamping/flow (molding) of material for thickness changes in portions of the metal sheet 124 in which thickness reducing and thickness increases are needed.

As shown in FIG. 13, the cooling system 114 is next operated to apply the quenching medium 117 between the laminated sheets 128 of the first tooling die 103 and the second tooling die 109 and directly against the first die susceptor 120 and the second die susceptor 121. Therefore, the quenching medium 117 may impinge directly against the first die susceptor 120 and the second die susceptor 121 and actively and rapidly cool the first tooling die 3 and the second tooling die 109 as well as the first die susceptor 120 and the second die susceptor 121. In turn, the first die susceptor 120 and the second die susceptor 121 quench the formed metal panel 132 sandwiched between the first die susceptor 120 and the second die susceptor 121. The formed metal panel 132 may remain sandwiched between the first tooling die 103 and the second tooling die 10 for a predetermined period of time until complete cooling or quenching of the formed metal panel 132 has occurred. This may allow the formed metal panel 132 to retain the structural shape which is defined by the first contoured surface 104 and the second contoured surface 110 after the first tooling die 103 and the second tooling die 109 are opened, as shown in FIG. 14. Once cooled to room temperature, the formed metal panel 132 may be removed from the apparatus 101 without loss of dimensional accuracy or stability of the formed metal panel 132 when it is cooled at an appropriate property-enhancing rate. The formed metal panel 132 may be subsequently aged to achieve maximum strength by any number of heating methods known to those skilled in the art. The first tooling die 103 and the second tooling die 109 may be made dimensionally thin and capable of being cooled at rates that enable the formed metal panel 132 to be solution treated.

The method may have the capability to form complex components in addition to performing the solution treatment of these components in the same rapid thermal cycle. The process may use induction heating with smart susceptors in conjunction with laminate tooling designs to create a forming tool that exhibits very little thermal inertia and heats rapidly and exactly to optimum forming/solution-treatment temperatures for the various aluminum alloys (between 900 F and 1000 F). This same process may be used to form and heat-treat magnesium alloys. These components may have very complex geometries as enabled by the ability to use gas forming and also molded in changes in thickness due to the ability to mold in changes in materials thicknesses. Therefore, high quality, complex, lightweight aluminum and magnesium near net shaped solution treated components may be fabricated rapidly and the needed dimensional control may still be achieved.

Figure 16:
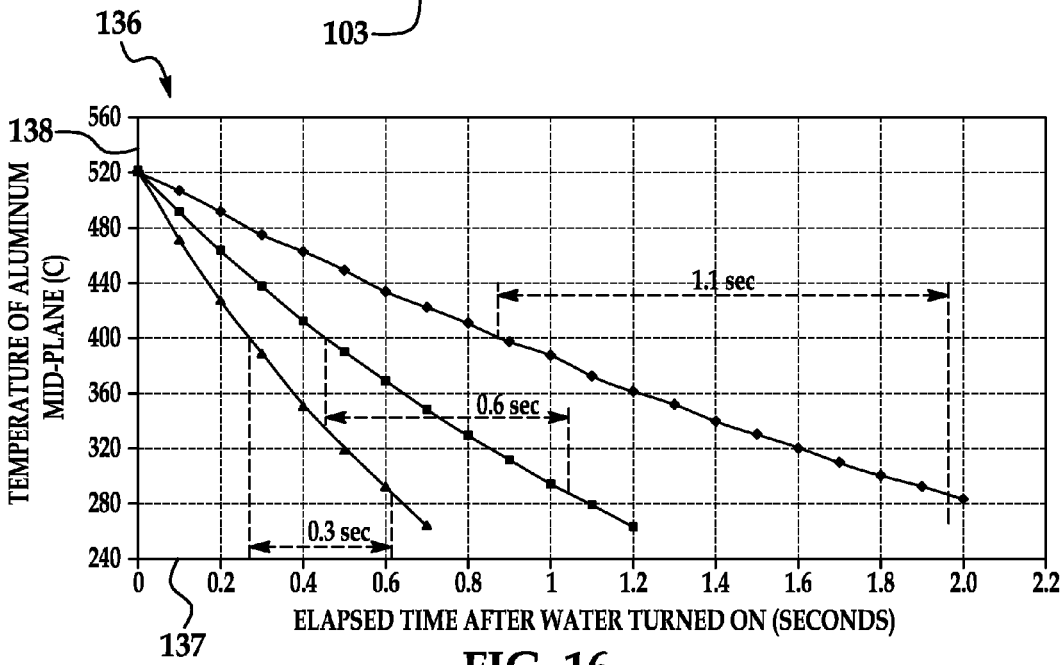
FIG. 16 is a graph which illustrates the effect of susceptor thickness on quenching rates of the shaped metal panel.

A graph 136 which illustrates the effect of susceptor thickness on quenching rates of the shaped metal panel is shown in FIG. 16. The elapsed time after quenching water is turned on (in seconds) is plotted along the X-axis 137. The temperature of the metal sheet mid-plane (degrees C.) is plotted along the Y-axis 138.

Figure 17:
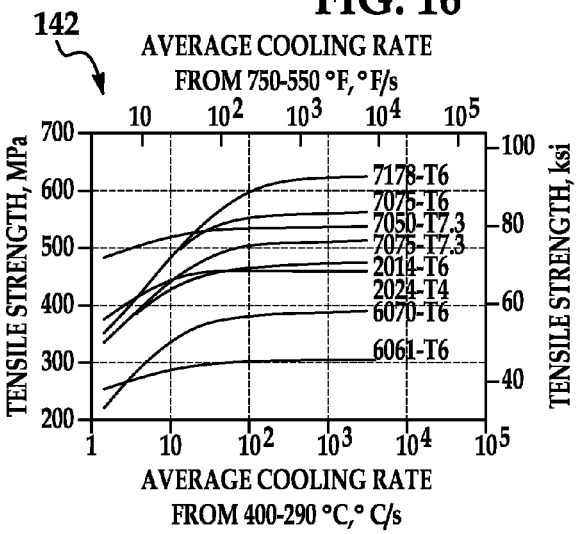
FIG. 17 is a graph which illustrates the required cooling rates needed to meet full alloy strength potentials.

A graph 142 which illustrates the required cooling rates needed to meet full alloy strength potentials is shown in FIG. 17. Typical heat treatment response of standard aluminum alloys given quenching rates shows that for thinner susceptors, adequate quenching for most alloys is attainable.

Figure 18:
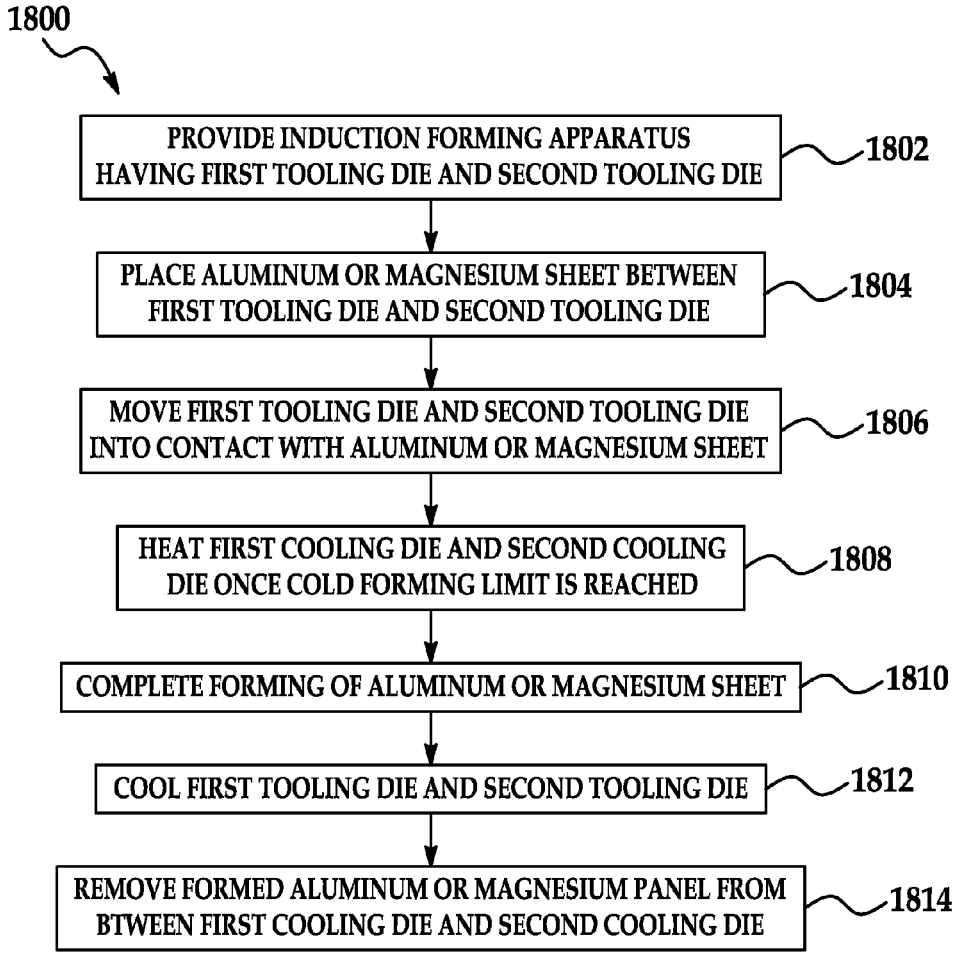
FIG. 18 is a flow diagram of a metal induction forming method.

Referring next to FIG. 18, a block diagram 1800 which illustrates an exemplary metal forming induction method is shown. In block 1802, an induction forming apparatus comprising a first tooling die and a second tooling die may be provided. In block 1804, a metal sheet may be placed between the first tooling die and the second tooling die. In some applications, the metal sheet may be aluminum, magnesium or alloys thereof. In block 1806, the first tooling die and the second tooling die may be moved into contact with the metal sheet. In block 1808, the first tooling die and the second tooling die may be heated once the cold forming limit of the first tooling die and the second tooling die has been reached. In block 1810, forming or shaping of the metal sheet may be completed. In block 1812, the resulting formed metal panel may be quenched by cooling the first tooling die and the second tooling die. The first tooling die and the second tooling die may be cooled by spraying a quenching medium against the first tooling die and the second tooling die. In some applications, the quenching medium may be water. In block 1814, the formed metal panel is removed from between the first tooling die and the second tooling die. In block 1816, in some embodiments the panel may be subjected to pressurized gas forming which follows hot die forming. This may enable a die design that need not be as exacting but can also leverage the speed and thinning pattern attributed to hot matched die forming (opposite that of hot forming).

Figure 19:
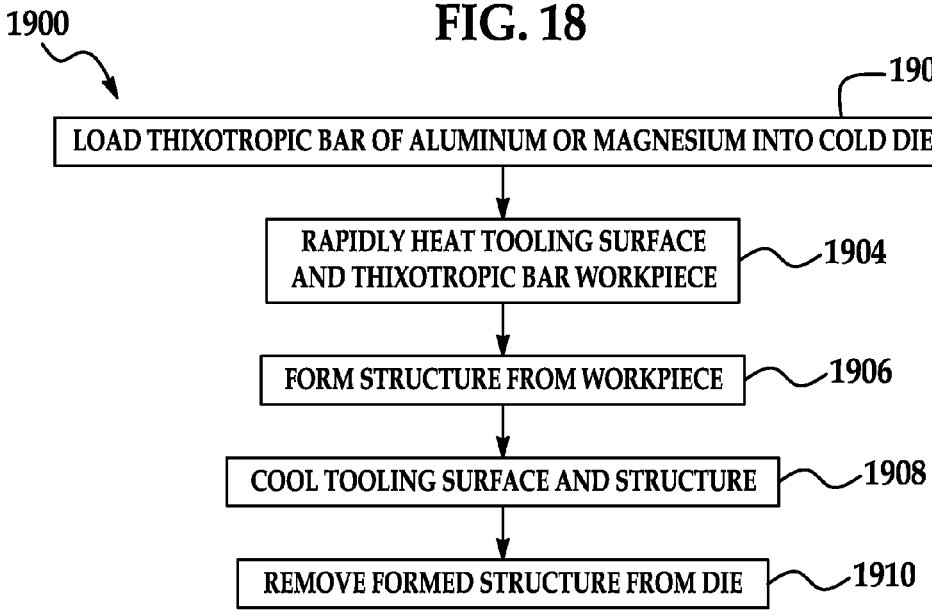
FIG. 19 is a flow diagram of a thixoforming method.

Referring next to FIG. 19, a flow diagram 1900 which illustrates an exemplary thixoforming process is shown. The process 1900 may be suitable for large thixoforming operations using thoxitropic blocks as the starting material. The process 1900 may be particularly suitable for magnesium due to the difficulty in producing sheet materials with magnesium. In block 1902, a thixotropic bar of aluminum or magnesium may be loaded into a cold die. In block 1904, the tooling surface and the thixotropic bar workpiece may be rapidly heated to facilitate flowing of the workpiece and enable formation of a large thin structure in block 1906. In block 1908, the tooling surface and the structure may be cooled. In block 1910, the formed structure may be removed from the die.

Figure 20:
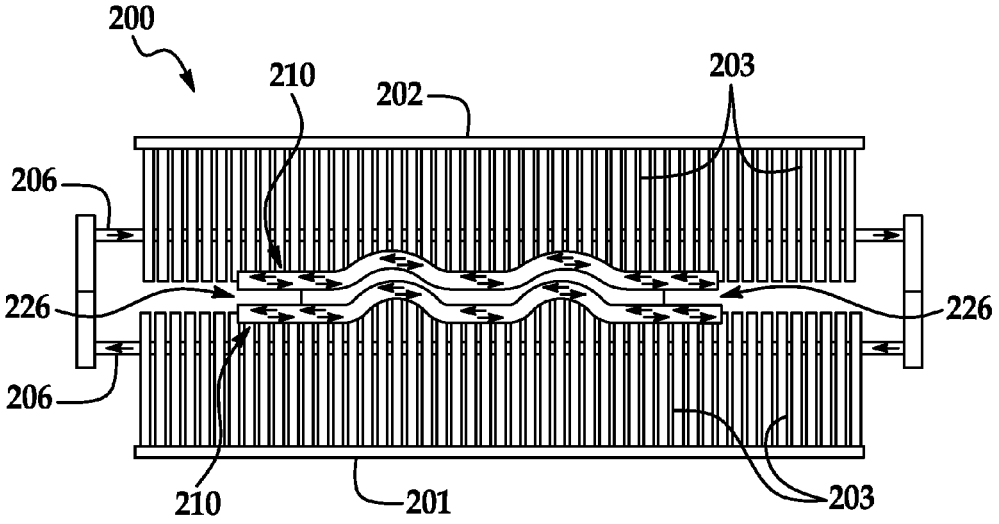
FIG. 20 is a sectional view of a pair of tooling dies of a laminated tooling apparatus, with a smart susceptor between the tooling dies.

Referring to FIGS. 20-25, an illustrative embodiment of a laminated tooling apparatus with smart susceptors, hereinafter apparatus, is generally indicated by reference numeral 200. As shown in FIG. 20, the apparatus 200 may include a first tooling die 201 and a second tooling die 202. Each of the first tooling die 201 and the second tooling die 202 may include multiple, parallel, spaced-apart laminated sheets 203 which may be austenitic stainless steel. An induction coil 206 may extend through and in generally perpendicular relationship to the laminated sheets 203. The induction coil 206 may have a solenoidal shape. A susceptor 210 may be provided on each of the first tooling die 201 and the second tooling die 202. In some embodiments, a susceptor gap 226 may exist between the susceptors 210 at the ends of the susceptors 210, as shown in FIG. 1.

Figure 23:
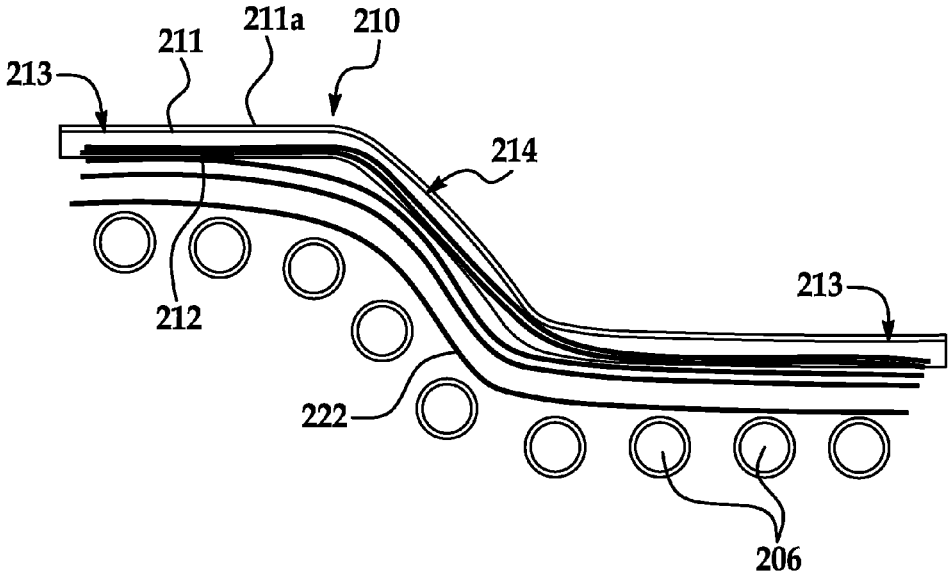
FIG. 23 is a cross-sectional view which illustrates the configuration of the magnetic field when the susceptor is in the ferromagnetic state.
Figure 24:
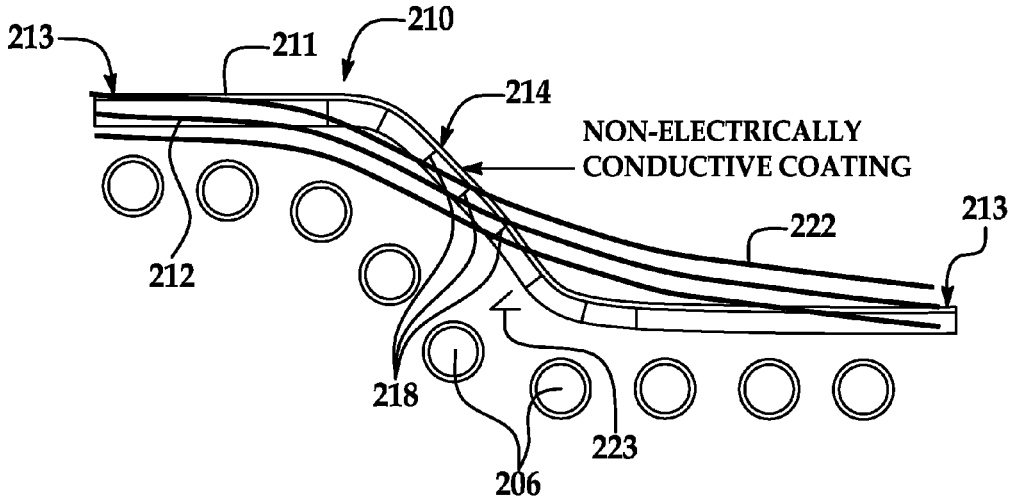
FIG. 24 is a cross-sectional view which illustrates the magnetic field penetrating the smart susceptor due to the presence of susceptor slots in the angled susceptor portions of the smart susceptor when the susceptor is in the non-ferromagnetic state.

Each susceptor 210 may be a ferromagnetic material such as iron, for example and without limitation, and, as shown in FIG. 23, may include a tooling surface 211 and a back surface 212. In complex designs, the susceptor 210 may have straight susceptor portions 213 and angled susceptor portions 214 adjacent to the straight susceptor portions 213. As shown in FIG. 24, a series of thin (typically 0.010" to 0.002") parallel susceptor slots 218 may extend through the thickness of each angled susceptor portion 214 of the susceptor 210. The susceptor slots 218 may extend from the back surface 212 of the angled susceptor portion 214. Nonconductive coatings 211*a* may be provided on the working side or tooling surface 211 (FIG. 23) of the susceptor 210. The nonconductive coatings 211*a* may be polymer based for lower temperatures (below ~700 F) and ceramic based for temperatures above 700 F. These coatings 211*a* may need to be thick enough to cover the susceptor slots 218 (thinner slots may be better from this standpoint).

Figure 21:
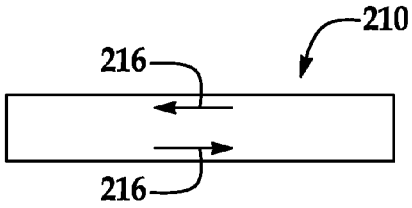
FIG. 21 is a schematic diagram which illustrates current flow in the smart susceptor in the magnetic state before the Curie Point has been reached when the magnetic field from the induction coil is running parallel to the plane of the smart.
Figure 22:
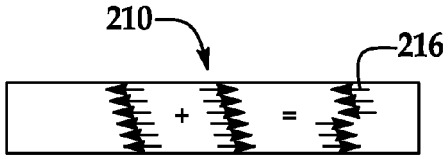
FIG. 22 is a schematic diagram which illustrates current flow in the smart susceptor in the non-magnetic state after the Curie Point has been reached when the magnetic field from the induction coil is running parallel to the plane of the smart susceptor.

FIG. 21 illustrates current flow 216 in the susceptor 210 in the ferromagnetic state and FIG. 22 illustrates current flow 216 in the susceptor 210 in the non-ferromagnetic state when the magnetic field produced by the induction coil 206 runs parallel to the back surface 212 (FIG. 23) of the susceptor 210. When the susceptor 210 is in the ferromagnetic state shown in FIG. 21, the magnetic field 222 from the induction coil 206 may tend to hug the back surface 212 of the susceptor 110, as shown in FIG. 23. This phenomenon may be due to the high magnetic permeability associated with the ferromagnetic material of the susceptor 210 in the ferromagnetic state.

FIG. 24 illustrates the magnetic field 222 when the susceptor 210 is in the non-ferromagnetic state (i.e. at or above the Curie Point). The magnetic field 222 may penetrate the plane of the angled susceptor portion 214 at a given angle 223. This phenomenon may be operable in the areas of the susceptor 210 in which the induction coil 206 runs perpendicular to the angled susceptor portions 214, which tend to be vertical rather than horizontal. The closer the angle 223 approaches 90 degrees, the less the current flow 216 may behave as shown in FIG. 21. As the angled susceptor portion 214 approaches a more vertical position, the closer the angle 223 may approach 90 degrees.

Figure 25:
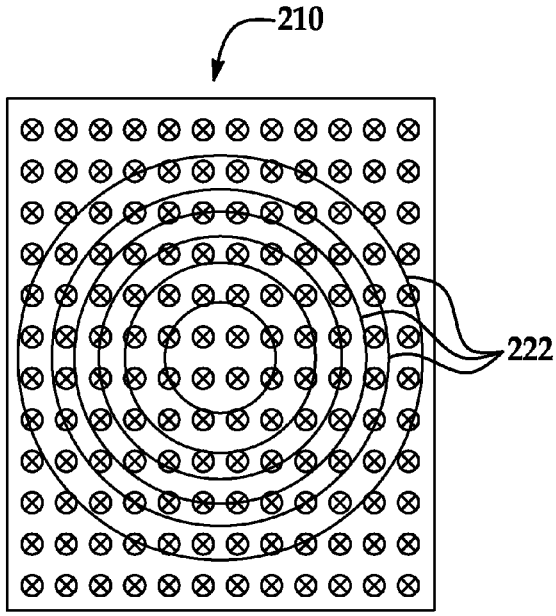
FIG. 25 illustrates the magnetic field penetrating the smart susceptor at an angle of 90 degrees with the general associated induced current path.
Figure 26:
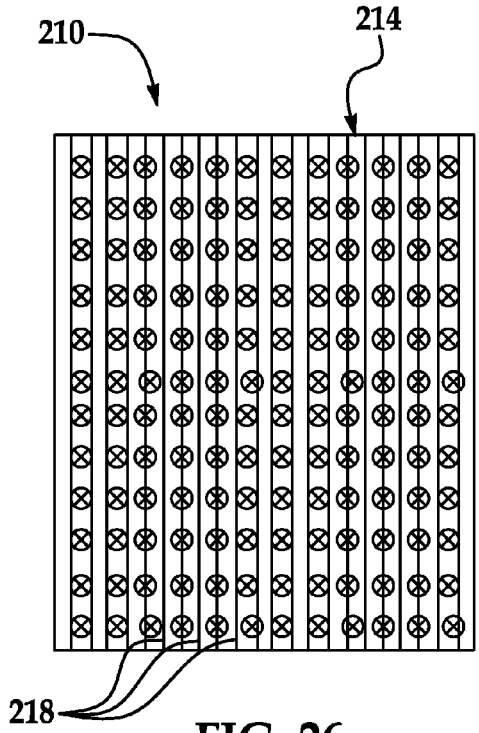
FIG. 26 illustrates cancellation of the circular induced current path illustrated in FIG. 24 by the introduction of susceptor slots in the smart susceptor.

FIG. 25 shows the path of the current 216 without the susceptor slots 218 when the angle 223 is equal to 90 degrees, whereas FIG. 26 shows cancellation of the current 216 by the susceptor slots 218. The presence of the susceptor slots 218 in the angled susceptor portions 214 of the susceptor 210 causes the susceptor 210 to heat rapidly to the Curie Point with the magnetic field 222 hugging the back surface 212 of the susceptor 210. Therefore, the current 216 may flow with the thickness of the susceptor 210 as shown in the magnetic state of FIG. 21. Accordingly, the magnetic field 222 can penetrate the susceptor 210 when it reaches the Curie Point as shown in FIG. 24 when the susceptor 210 becomes non-ferromagnetic with no overheating of the susceptor 210. The susceptor slots 218 may enable the intrinsic thermal control by the susceptors 210 for complex susceptor geometries by blunting current paths that do not force induced current cancellation in the non-ferromagnetic state of the susceptors 210.

Figure 27:
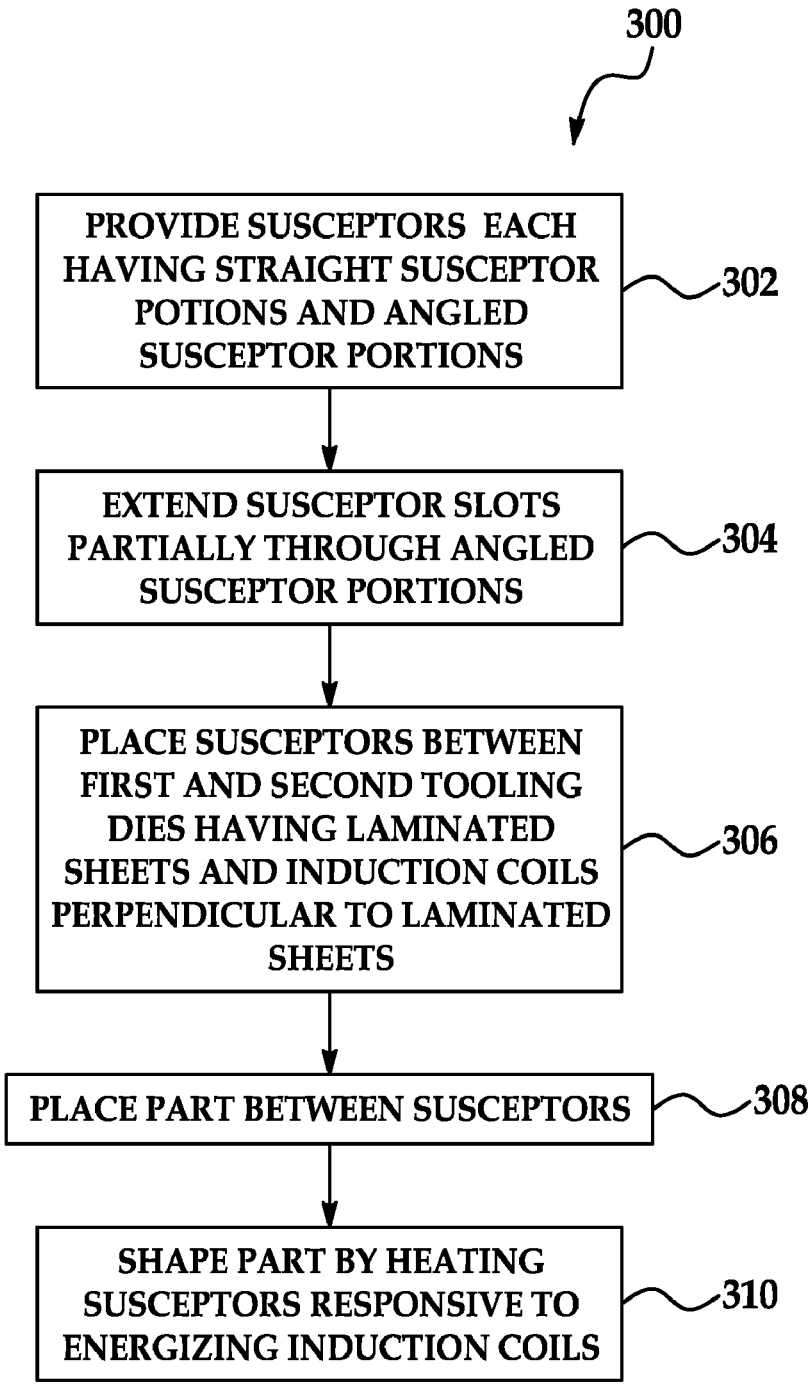
FIG. 27 is a flow diagram of an illustrative method of enhancing induction heating control of a susceptor in a laminated tooling apparatus.

Referring next to FIG. 27, a flow diagram 300 which illustrates a method of enhancing induction heating control of a susceptor in a laminated tooling apparatus is shown. In block 302, susceptors each having a complex geometry which may include straight susceptor portions and angled susceptor portions are provided. In block 304, susceptor slots may be extended partially through the angled susceptor portions of each susceptor. In block 306, the susceptors may be placed between first and second tooling dies having laminated sheets and induction coils extending through and perpendicular to the laminated sheets. In block 308, a part may be placed between the susceptors. In block 310, the part may be shaped by heating the susceptors responsive to energizing the induction coils. The susceptor slots in the angled susceptor portions of each susceptor may enable the magnetic field to penetrate the susceptor when the susceptor becomes non-ferromagnetic at the Curie Point. This may prevent overheating of the susceptor and enhance accuracy in heating and shaping of the part.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A laminated tooling apparatus, comprising:
a first tooling die;
a first susceptor carried by the first tooling die and having at least one straight susceptor portion and at least one angled susceptor portion adjacent to the straight susceptor portion;
a first plurality of susceptor slots extending partially through the at least one angled susceptor portion of the first tooling die;
a second tooling die adjacent to the first tooling die;
a second susceptor carried by the second tooling die and having at least one straight susceptor portion and at least one angled susceptor portion adjacent to the straight susceptor portion; and
a second plurality of susceptor slots extending partially through the at least one angled susceptor portion of the second tooling die.

2. The apparatus of claim 1 wherein each of the first tooling die and the second tooling die comprises a plurality of laminated sheets and an induction coil extending through the laminated sheets.

3. The apparatus of claim 2 wherein the laminated sheets comprise austenitic stainless steel.

4. The apparatus of claim 2 wherein the induction coil is generally perpendicular to the laminated sheets.

5. The apparatus of claim 2 wherein the induction coil is a solenoidal shaped induction coil.

6. The apparatus of claim 1 wherein each of the first susceptor and the second susceptor comprises at least one of iron, nickel or cobalt.

7. The apparatus of claim 1 wherein each of the first susceptor and the second susceptor has a back surface generally facing the induction coil and a tooling surface opposite the back surface.

8. The apparatus of claim 7 wherein the first plurality of susceptor slots and the second plurality of susceptor slots extends from the back surface toward the tooling surface of the first susceptor and the second susceptor, respectively.

9. A laminated tooling apparatus, comprising:
a first tooling die;
a first susceptor carried by the first tooling die and having a plurality of straight susceptor portions and a plurality of angled susceptor portions adjacent to the straight susceptor portions;
a first plurality of susceptor slots extending through at least one angled susceptor portion of the first tooling die;
a second tooling die adjacent to the first tooling die;
a second susceptor carried by the second tooling die and having a plurality of straight susceptor portions and a plurality of angled susceptor portions adjacent to the straight susceptor portions; and
a second plurality of susceptor slots extending through at least one angled susceptor portion of the second tooling die.

10. The apparatus of claim 9 wherein each of the first tooling die and the second tooling die comprises a plurality of laminated sheets and an induction coil extending through the laminated sheets.

11. The apparatus of claim 10 wherein the laminated sheets comprise austenitic stainless steel.

12. The apparatus of claim 10 wherein the induction coil is generally perpendicular to the laminated sheets.

13. The apparatus of claim 10 wherein the induction coil is a solenoidal shaped induction coil.

14. The apparatus of claim 9 wherein each of the first susceptor and the second susceptor comprises at least one of iron, nickel or cobalt.

15. The apparatus of claim 9 wherein each of the first susceptor and the second susceptor has a back surface generally facing the induction coil and a tooling surface opposite the back surface.

16. The apparatus of claim 15 wherein the first plurality of susceptor slots and the second plurality of susceptor slots extends from the back surface toward the tooling surface of the first susceptor and the second susceptor, respectively.

17. A method of enhancing induction heating control of a susceptor in a laminated tooling apparatus, comprising:
providing susceptors each having at least one straight susceptor portion and at least one angled susceptor portion adjacent to the at least one straight susceptor portion;
extending susceptor slots through the angled susceptor portions;
placing the susceptors between first and second tooling dies;
placing a part between the susceptors; and
shaping the part by heating the susceptors.

18. The method of claim 17 wherein placing the susceptors between first and second tooling dies comprises placing the susceptors between first and second tooling dies each having a plurality of laminated sheets and an induction coil extending through the laminated sheets.

19. The method of claim 18 wherein providing susceptors comprises providing susceptors each having a back surface generally facing the induction coil and a tooling surface opposite the back surface and wherein extending susceptor slots through the angled susceptor portions comprises extending the susceptor slots from the back surface toward the tooling surface of each susceptor.

20. The method of claim 17 wherein providing susceptors each having at least one straight susceptor portion and at least one angled susceptor portion adjacent to the at least one straight susceptor portion comprises providing susceptors each having a plurality of straight susceptor portions and a plurality of angled susceptor portions adjacent to the straight susceptor portions.

* * * * *